United States Patent [19]

Tannenbaum et al.

[11] 3,957,550

[45] May 18, 1976

[54] FLAME-EXPLOSION COUPLE

[75] Inventors: Stanley Tannenbaum, Morristown; Clyde J. Poulin, Mount Arlington, both of N.J.

[73] Assignee: Thiokol Corporation, Newtown, Pa.

[22] Filed: Sept. 13, 1966

[21] Appl. No.: 580,562

[52] U.S. Cl. ..... 149/35; 44/7 A; 44/51; 149/19.5; 149/19.91; 149/20; 149/26; 149/33; 149/34; 149/36; 149/42; 149/43; 149/44; 149/67; 149/75; 149/76; 149/83; 149/87

[51] Int. Cl.[2] ..... C06B 35/00

[58] Field of Search ..... 44/7; 149/18, 19, 20, 149/26, 35, 36, 42, 43, 76, 78, 33, 34

[56] References Cited

UNITED STATES PATENTS 1,329,525 2/1920 Hudson ..... 149/35

3,112,233 11/1963 Friedman et al. ..... 149/35 X

*Primary Examiner*—Leland A. Sebastian

[57] ABSTRACT

A flame-explosion couple is disclosed which upon ignition burns for a period of time in a relatively stable manner and thereafter explodes to produce fragments which continue to burn for a further period of time. The composition may comprise from 40 to 89 percent by weight of a volatile liquid fuel, from 10 to 50 percent by weight of a secondary explosive or strong metal salt oxidizer and from 0.5 to 5 percent by weight of an explosive primer. It is usually desirable to incorporate a gellant in the composition to give it a jellylikc consistency of a desired viscosity. The composition may optionally contain combustible metal powders and combustible polymers.

10 Claims, No Drawings

FLAME-EXPLOSION COUPLE

This invention relates to incendiary compositions for military applications and more particularly to a flame-explosion couple, that is to say, a composition which when ignited burns for a predeterminable period of time and thereafter explodes and spreads burning material over an extended area.

The value of flame weapons used in support of tactical operations has been well established in actual combat situations. They are employed for their psychological and physiological effects on enemy personnel and for their destructive effect on combustible targets. However, flame weapons have heretofore suffered from the limitation that in many situations their effect has been limited to the immediate vicinity of the point at which they are brought to bear. For example, an enemy may be concealed in a relatively inaccessible maximum security location such that the flame weapon cannot be brought directly to bear on him. Under these circumstances because of the limited area of effectiveness of conventional flame weapons the enemy might feel relatively safe from attack and not compelled to withdraw from his position.

In accordance with the present invention, this disadvantage of conventional flame weapons is overcome by providing a flame-explosion couple, that is, a composition which burns for a certain period of time and then explodes to project burning masses of the composition for considerable distances. In some cases the projected masses themselves later explode and thus with the present compositions a considerable area can be blanketed with the flaming incendiary material.

It is accordingly an object of the invention to provide a flame weapon of increased effectiveness. It is another object to provide a novel type of incendiary composition which is effective over a greater area than prior incendiary compositions. It is still another object of the invention to provide an incendiary composition of this type that is relatively easy and inexpensive to manufacture. Other objects of the invention will be in part obvious and in part apparent as the description proceeds.

The objects and advantages of the present invention can be achieved in general by formulating a composition which is an intimate mixture of a major amount of a combustible liquid, a minor but substantial amount of a secondary explosive or a strong oxidizer and a small amount of a primary explosive. When the composition is ignited, combustion is initially supported by the combustible liquid or fuel. As burning proceeds, the concentrations of the explosive components and the temperature of the composition both increase. After a certain time interval which depends upon the nature of the ingredients and the proportions in which they are used in the composition, the primary explosive is activated to detonate the secondary explosive and thereby project flaming portions of the composition for considerable distances.

The combustible liquid component of the composition may be any of a wide variety of organic liquids, particularly those that are known to be useful as fuels. Thus the fuel component may be gasoline or individual hydrocarbon compounds such as pentane, hexane and heptane. Amines such as alkylamines, hydrazine and alkyl-substituted hydrazines may be used, as well as alcohols, organic acids, esters, ethers, carbonyls and nitriles. In fact any fairly volatile liquid fuel can be employed as the combustible liquid of the composition.

The preferred fuels are hydrocarbons or mixtures of hydrocarbons, having say 4 to 8 carbon atoms.

The combustible liquid component may also have combustible solid ingredients dissolved or dispersed therein. For example, combustible polymers, e.g., polystyrene, polyisobutylene, poly-methylmethacrylate and/or poly-butylmethacrylate, may be incorporated in the liquid component. Also powders of metals such as aluminum and magnesium may be used.

Secondary explosives that may be used in the present compositions include hydrazine and ammonium perchlorates and nitrates, di- and trinitrotoluene, nitromethane, tetranitromethane, trinitrophenylmethylnitramine (Tetryl), cyclotrimethylenetrinitramine (RDX), pentaerythritol tetranitrate (PETN), picric acid, ammonium picrate and ethylenediaminedinitrate (EDNA). The primary explosive may be a conventional explosive primer and includes such materials as lead azide, mercury fulminate, lead styphnate, diazodinitrophenol and nitromannite. Especially effective results have been obtained when using hydrazine nitrate as a secondary explosive and lead azide as the primary explosive.

It has been further found that strong, inorganic oxidizers can be used in place of, or in addition to, the secondary explosive component. Such oxidizers form with the combustible liquid an explosive mixture which, after an initial burning period, is detonated by the primary explosive. Useful oxidizers for this purpose include sodium, potassium and lithium perchlorates, sodium nitrate and the like. It will be noted that certain of the secondary explosives mentioned above, e.g., ammonium perchlorate, can be considered both secondary explosives and oxidizers.

It has been found desirable in most cases to incorporate a small amount of a gellant in the present compositions. The gellant performs a number of functions. Thus in cases where either or both of the explosive components is insoluble in the fuel component, the gellant insures uniform distribution of the explosive materials through the composition. Also a composition having a somewhat viscous consistency is easier to handle and apply and more effective in use.

A further advantage of using the gellant arises out of the fact that it provides a means of controlling the rheological properties of the composition. In general, the composition should desirably have a thinly viscous consistency, but the desirable consistency varies to some extent depending upon the nature of the surface to which the composition is to be applied. Thus if the composition is applied to an irregular surface, the surface irregularities tend to confine the composition during the burning period and prevent excessive spreading thereof. If on the other hand the composition is applied to a smooth horizontal surface, there is a tendency for the composition to spread out excessively and prevent either activation of the primary explosive or detonation of the secondary explosive. In the latter case the proportion of gellant is desirably increased to increase the viscosity of the composition and prevent such excessive spreading. The quantity of gellant used normally falls within the range 0.5 to 10 percent by weight of the composition.

Gellants suitable for use in the present compositions are known in the art. They include, for example, metal soaps of fatty acids, e.g., the aluminum soap of a mixture of oleic, cocoanut oil and naphthenic acid sold under the trade designation "M-1" and an aluminum soap of a mixture of isooctanoic acids sold under the trade designation "M-4." Commercial mixtures of such soaps with minor amounts of silica aerogel may also be used, as well as thickeners based on natural rubber latex and other thickeners or gellants known to be useful in thickening liquid hydrocarbon compositions.

As indicated above, the use of a gellant is not essential in all cases. Thus it may be omitted in compositions wherein the explosive components are either soluble in or remain suspended in the combustible liquid.

In accordance with a preferred procedure for formulating the present compositions the combustible liquid is first added to the primary explosive and mixed therewith. The secondary explosive or oxidizer is then added to this mixture and thereafter the gellant, if used, is added. In the case of small quantities the mixture may be hand shaken whereas in preparing larger quantities a mechanical mixer such as a paint mixer may be used. In either event, thorough mixing of the components is desirable. The preferred compositions contain from 40 to 89 percent by weight of combustible liquid, from 10 to 50 percent by weight of secondary explosive, 0.5 to 5 percent by weight of primary explosive, and from 0.5 to 10 percent by weight of gellant.

The preferred mixing procedure is desirably used in the case of compositions whose behavior is sharply dependent on rheological properties. However, in other cases acceptable results can be achieved by simply mixing the ingredients without regard to the order in which the ingredients are mixed.

In order to point out more fully the nature of the present invention the following specific examples are given of compositions prepared in accordance with the invention.

EXAMPLE 1

A flame-explosion couple having the following composition in parts by weight was prepared and tested.

| Component | Parts by Weight |
|---|---|
| Gasoline | 10 |
| Hydrazine nitrate (fine crystals) | 3 |
| Undextrinated lead azide | 0.25 |
| M-4 Gellant | 1 |

Approximately 15 grams of this composition was put in each of three 2-inch diameter aluminum cups and ignited. In each case the material burned for about 2 minutes and then exploded with considerable force.

EXAMPLE 2

A flame-explosion couple was prepared having the following composition.

| Component | Parts by Weight |
|---|---|
| Pentane | 10 |
| Hydrazine nitrate | 3 |
| Lead azide | 0.25 |
| M-4 Gellant | 1.5 |

This composition was tested to determine its effect on a test panel, namely, a five-layer, half-inch thick piece of plywood measuring 9 × 11 inches and supported in a horizontal position at its edges. About 15 grams of the above composition was poured on the plywood panel to form a circular puddle about 2.5 inches in diameter. Upon ignition the material burned for a period of about 2 minutes and then detonated. The explosion blew a clean hole through the board about the size of the sample, i.e., about 2.5 inches in diameter.

In another test the same amount of the same composition was poured on the horizontal portion of a plywood "corner" and ignited. The resulting detonation shattered the base of the test piece and blew the vertical members apart.

EXAMPLE 3

A composition was prepared like that of Example 2 except that hexane was used in place of pentane and the concentration of M-4 gellant was 2.0 percent. Samples of this composition when tested gave burning times of 171 to 198 seconds prior to detonation.

EXAMPLE 4

A composition was prepared like that of Example 3 except that heptane was used in place of hexane. Samples having this composition when ignited gave burning times of 109 to 183 seconds prior to detonation.

EXAMPLE 5

A flame-explosion couple was prepared having the following composition:

| Component | Parts by Weight |
|---|---|
| Gasoline | 72 |
| Ammonium perchlorate | 25 |
| Lead Azide | 3 |
| M-1 Gellant | 1 |

Samples of this composition were placed in two-inch diameter aluminum test cups and ignited. They burned for about 2 minutes and thereafter exploded with considerable force.

EXAMPLE 6

A composition was prepared similar to that of Example 5 except that ammonium nitrate was substituted for ammonium perchlorate. The resulting composition when tested as in Example 5 gave similar results.

EXAMPLE 7

In order to indicate the manner in which burning time prior to detonation varies with variations in the proportions of the components of the composition, data are given below on several compositions prepared with gelled gasoline, hydrazine nitrate, and lead azide. The values given are averages of the results obtained from testing a number of samples.

| Gelled Gasoline | HN | Lead Azide | Burning Time in Seconds |
|---|---|---|---|
| 73.3 | 24.2 | 2.5 | 165 |
| 50 | 48.1 | 1.9 | 104 |
| 88.1 | 9.9 | 2.0 | 181 |

EXAMPLE 8

A flame-explosion couple was prepared having the following composition:

| Component | Parts by Weight |
|---|---|
| Pentane | 40 |
| Ammonium perchlorate | 9 |
| Hydrazine nitrate | 6 |
| Polystyrene (1-3 mm particles) | 40 |
| Lead azide | 2.5 |
| M-4 gellant | 2.5 |

A quantity of the foregoing composition was placed on an aluminum sheet and ignited. After several minutes of burning it gave a high order detonation.

EXAMPLE 9

A flame-explosion couple was prepared having the following composition:

| Component | Parts by Weight |
|---|---|
| Pentane | 56 |
| Lithium perchlorate | 40 |
| Lead azide | 3 |
| M-4 Gellant | 1 |

A quantity of this composition was placed on a wood panel and ignited. After a brief burning period it detonated with moderate energy.

It is evident that compositions of the type described herein should not only be effective in use but should also be reasonably safe to handle prior to use. To determine the safety of the present compositions shock sensitivity tests were run in a modified Trauzl block. The test blocks were standard lead cylinders 2.5 inches high and 2 inches in diameter with an internal bore one inch in diameter. A No. 8 electric blasting cap was used as the initiating source. In the tests from 0.5 to 2.0 grams of the flame-explosion couple material was charged into a glass vial and placed into the cylinder along with the blasting cap. The cap was electrically detonated and the test block examined thereafter to determine the amount of deformation that had occurred.

In one series of tests compositions like those of Example 1 were prepared with varying amounts of hydrazine nitrate therein. It was found in these tests that no detonation of the composition occurred until the hydrazine nitrate content had reached about 90 percent. In another series of tests the lead azide concentration was varied and it was found that no detonation occurred at lead azide concentrations within the range claimed in the present application, i.e., at concentrations below 6 percent by weight. Thus these tests indicated that the present compositions can be safely handled prior to ignition.

It is of course to be understood that the foregoing Examples are intended to be illustrative only and that numerous changes can be made in the ingredients and proportions disclosed therein without departing from the spirit of the present invention as defined in the appended claims.

We claim:

1. A flame-explosion couple comprising an intimate mixture of a major amount of a volatile liquid fuel, a minor but substantial amount of a component which is a secondary explosive selected from the group consisting of hydrazine, ammonium perchlorate, ammonium nitrate, dinitrotoluene, trinitrotoluene, nitromethane, tetranitromethane, trinitrophenylmethylnitramine, cyclotrimethylenetrinitramine, pentaerythritol tetranitrate, picric acid, ammonium picrate and ethylenediaminedinitrate or a strong oxidizer selected from the group consisting of sodium, ptassium, lithium and ammonium perchlorates and sodium nitrate and a small amount of a primary explosive selected from the group consisting of lead azide, mercury fulminate, lead styphnate, diazodinitrophenol and nitromannite.

2. A flame-explosion couple comprising an intimate mixture of from 40 to 89 percent by weight of a volatile liquid fuel, from 10 to 50 percent of a component which is a secondary explosive selected from the group consisting of hydrazine, ammonium perchlorate, ammonium nitrate, dinitrotoluene, trinitrotoluene, nitromethane, tetranitromethane, trinitrophenylmethylnitramine, cyclotrimethylenetrinitramine, pentaerythritol tetranitrate, picric acid, ammonium picrate and ethylenediaminedinitrate or a strong oxidizer selected from the group consisting of sodium, potassium, lithium and ammonium perchlorates and sodium nitrate and from 0.5 to 5 percent of a primary explosive selected from the group consisting of lead azide, mercury fulminate, lead styphnate, diazodinitrophenol and nitromannite.

3. A flame-explosion couple comprising an intimate mixture of from 40 to 89 percent by weight of a volatile liquid fuel, from 10 to 50 percent of a component which is a secondary explosive selected from the group consisting of hydrazine, ammonium perchlorate, ammonium nitrate, dinitrotoluene, trinitrotoluene, nitromethane, tetranitromethane, trinitrophenylmethylnitramine, cyclotrimethylenetrinitramine, pentaerythritol tetranitrate, picric acid, ammonium picrate and ethylenediaminedinitrate or a strong oxidizer selected from the group consisting of sodium, potassium, lithium and ammonium perchlorates and sodium nitrate and from 0.5 to 5 percent of a primary explosive selected from the group consisting of lead azide, mercury fulminate, lead styphnate, diazodinitrophenol and nitromannite and from 0.5 to 10 percent by weight of a gellant.

4. A composition according to claim 3 and wherein the volatile liquid fuel is a liquid hydrocarbon.

5. A composition according to claim 3 and wherein the primary explosive is lead azide.

6. A flame-explosion couple comprising an intimate mixture of a major amount of a volatile liquid fuel, a minor but substantial amount of a component which is a secondary explosive selected from the group consisting of hydrazine, ammonium perchlorate, ammonium nitrate, dinitrotoluene, trinitrotoluene, nitromethane, tetranitromethane, trinitrophenylmethylnitramine, cyclotrimethylenetrinitramine, pentaerythritol tetranitrate, picric acid, ammonium picrate and ethylenediamine dinitrate or a strong oxidizer selected from the group consisting of sodium, potassium, lithium and ammonium perchlorates and sodium nitrate and a small amount of a primary explosive selected from the group consisting of lead azide, mercury fulminate, lead styphnate, diazodinitrophenol and nitromannite.

7. A flame-explosion couple comprising an intimate mixture of from 40 to 89 percent by weight of a volatile liquid fuel, from 10 to 50 percent of a component which is a secondary explosive selected from the group consisting of hydrazine, ammonium perchlorate, ammonium nitrate, dinitrotoluene, trinitrotoluene, nitromethane, tetranitromethane, trinitrophenylmethylnitramine, cyclotrimethylenetrinitramine, pentaerythritol tetranitrate, picric acid, ammonium picrate and ethylenediaminedinitrate or a strong oxidizer selected from the group consisting of sodium, potassium, lithium and ammonium perchlorates and sodium nitrate and from 0.5 to 5 percent of a primary explosive selected from the group consisting of lead azide, mercury fulminate, lead styphnate, diazodinitrophenol and nitromannite.

8. A flame-explosion couple comprising an intimate mixture of from 40 to 89 percent by weight of a volatile liquid fuel, from 10 to 50 percent of a component which is a secondary explosive selected from the group consisting of hydrazine, ammonium perchlorate, ammonium nitrate, dinitrotoluene, trinitrotoluene, nitromethane, tetranitromethane, trinitrophenylmethylnitramine, cyclotrimethylenetrinitramine, pentaerythritol tetranitrate, picric acid, ammonium picrate and ethylenediaminedinitrate or a strong oxidizer selected from the group consisting of sodium, potassium, lithium and ammonium perchlorates and sodium nitrate and from 0.5 to 5 percent of a primary explosive selected from the group consisting of lead azide, mercury fulminate, lead styphnate, diazodinitrophenol and nitromannite and from 0.5 to 10 percent by weight of a gellant.

9. A composition according to claim 8 and wherein the volatile liquid fuel has a combustible polymer dispersed therein.

10. A composition according to claim 8 and wherein the volatile liquid fuel has an aluminum or magnesium powder dispersed therein.

* * * * *